United States Patent [19]

Pao Chen

[11] 4,433,943

[45] Feb. 28, 1984

[54] METHOD AND APPARATUS FOR FORMING SUBTERRANEAN CONCRETE PILES

[76] Inventor: Paul C. Pao Chen, 3D Wang Fung Ter., 1st Floor, Tai Hang Rd., Hong Kong, Hong Kong

[21] Appl. No.: 120,879

[22] Filed: Feb. 12, 1980

[30] Foreign Application Priority Data

Feb. 13, 1979 [GB] United Kingdom ..... 7905127

[51] Int. Cl.[3] ..... E02D 5/34

[52] U.S. Cl. ..... 405/241; 405/239; 405/233; 406/48; 406/93

[58] Field of Search ..... 405/241, 240, 236, 258, 405/232, 233, 238; 166/290, 289; 406/46–48, 154, 194, 93

[56] References Cited

U.S. PATENT DOCUMENTS

| | | | |
|---|---|---|---|
| 1,856,604 | 5/1932 | Upson | 405/240 X |
| 1,954,005 | 4/1934 | Westberg | 406/93 X |
| 2,176,891 | 10/1939 | Crom | 406/154 X |
| 2,412,239 | 12/1946 | Weber | 405/236 |
| 2,746,728 | 5/1956 | Pomerleau | 406/47 X |
| 2,920,455 | 1/1960 | Ryser et al. | 405/241 |
| 3,300,988 | 1/1967 | Phares et al. | 405/241 X |
| 3,391,544 | 7/1968 | Daczko | 405/241 |
| 3,707,848 | 1/1973 | Chelminski | 405/240 X |
| 3,712,681 | 1/1973 | Marino et al. | 406/48 |
| 3,808,823 | 5/1974 | Chelminski | 405/240 X |
| 3,907,170 | 9/1975 | Schedrin et al. | 406/47 |
| 4,126,007 | 11/1978 | Mars | 405/240 X |
| 4,154,486 | 5/1979 | Nishikawa | 406/48 |
| 4,269,544 | 5/1981 | Rusche | 405/233 X |

FOREIGN PATENT DOCUMENTS

| | | |
|---|---|---|
| 886999 | 1/1962 | United Kingdom . |
| 954842 | 4/1964 | United Kingdom . |
| 1328159 | 8/1973 | United Kingdom . |
| 1352064 | 1/1974 | United Kingdom . |
| 1520323 | 8/1978 | United Kingdom . |

*Primary Examiner*—Dennis L. Taylor
*Attorney, Agent, or Firm*—Spencer & Frank

[57] ABSTRACT

A concrete pile is formed by forming a hole in the ground with an auger and introducing concrete material into the ground through the hollow stem of the auger, the concrete being forceably ejected from the hollow stem of the auger by compressed air supplied to a nozzle within the hollow stem of the auger adjacent the open end thereof. The auger is gradually withdrawn from the hole as the hole is filled with concrete. The auger is made of inter-connected auger sections, the sections being connected by couplers which provide channels for the flow of concrete and for the flow of compressed air. The auger bit is provided with an appropriate nozzle for the ejection of the compressed air.

3 Claims, 9 Drawing Figures

74
75
76

18
21

18
21

18
21

18
21

METHOD AND APPARATUS FOR FORMING SUBTERRANEAN CONCRETE PILES

BACKGROUND TO THE INVENTION

The present invention relates to a method and apparatus for forming subterranean concrete piles.

It has been proposed to form subterranean concrete piles by driving a casing tube, by means of impacts, into the ground either by the displacement method, in which a pointed nose cone is applied to the casing tube to divert soil from the space to be occupied by the tube, or by the bored casing method, in which the casing is bored into the ground and the soil contained within the casing is subsequently removed. The disadvantages of these methods are that the casing tube has a smooth exterior, and also substantial headroom must be available to enable the casing to be driven into the ground.

OBJECT OF THE INVENTION

The invention seeks to provide a process and an apparatus in which the disadvantages of prior proposed processes are obviated or reduced.

SUMMARY OF THE INVENTION

According to one aspect of this invention there is provided a method for forming a pile, said method comprising the step of forming a hole in the ground, and introducing concrete material into the hole in the ground through a tubular member, the concrete material being forceably ejected from the tubular member by means of compressed air supplied to a nozzle within the tubular member adjacent the open end thereof, the tubular member being gradually withdrawn from the hole as the hole is filled with concrete.

The concrete material may be a wet concrete material comprising an appropriate mixture of cement, sand and/or aggregate and/or other material and water, but in an alternative embodiment of the invention the concrete material may be a dry material, water being added to the concrete material at the nozzle.

Preferably the tubular member comprises the central stem of a helical auger utilised for forming the hole. Conveniently the auger may comprise a plurality of interconnected auger segments, each auger segment defining a means for conveying the concrete material and means for conveying compressed air. Each auger segment may comprise means for conveying water, and the water conveying means may be the sme as the compressed air conveying means. The auger elements are provided with appropriate interconnecting couplers.

The invention also relates to a pile when formed by the above described method.

According to another aspect of this invention there is provided an auger, said auger comprising an elongate member defining at least two passages extending substantially axially, a first one of said passages being for the flow of concrete material, and the second one of said passages being for the flow of compressed air the first two passages merging in a nozzle adjacent an open end of the first passage at one end of the auger, the auger being provided with an appropriate external helix or other drilling means.

According to a further aspect of this invention there is provided a piling rig comprising an auger drive mechanism, and means for supporting the drive mechanism and an auger according to said one aspect said rig being provided with means for introducing concrete material and compressed air to said passages, the arrangement being such that the flows of concrete and compressed air combined in said nozzle means so that the concrete is forceably ejected from said nozzle.

Preferably said rig comprises leaders supporting the auger drive mechanism and advantageously the leaders are mounted on a vehicle such as a crawler. However, the leaders may also conveniently be suspended from a crane or mounted on skids.

Advantageously the rig is provided with means for supplying water to the auger, and the auger is provided with a channel, for example the passage provided for the flow of compressed air, for accommodating the flow of water.

Preferably the auger is provided with a bit having means for combining the flow of concrete material and air (and water, if provided) said bit including a ring member surrounding a portion of a bore accommodating the flow of concrete material and including a plurality of apertures opening into said bore through which said air (and said water, if provided) is introduced to the bore containing concrete material.

An auger according to the invention may be provided an auger bit, said bit comprising a member defining a substantially central passage for accommodating the flow of concrete material from said first passage, a discharge passage defining a discharge for the concrete material, an annular member surrounding and partly defining said passage, and channels in said annular member leading from said second passage, which comprises a source of compressed air, to apertures in the wall of said discharge passage.

One embodiment of the invention may comprise a plurality of sections interconnected by couplers, each said coupler comprising interlocking members, the interlocking members each defining a substantially central axial bore defining a part of the first passage and the members each defining further passages defining part of the second passage and which terminate at an annular groove in an end face of the member which is adapted to abut a corresponding end face of another member provided with a corresponding annular groove connected with further passages.

Preferably the said interlocking members are adapted to interconnect by means of male and female interconnecting parts, and conveniently the male and female parts may each be of conical shape and may be provided with threading. However, other types of connections may be used.

BRIEF DESCRIPTION OF THE DRAWINGS

In order that the invention may be more readily understood, and so that further features thereof may be appreciated, the invention will now be described by way of example with reference to the accompanying drawings in which.

DESCRIPTION OF PREFERRED EMBODIMENTS

Figure 1:
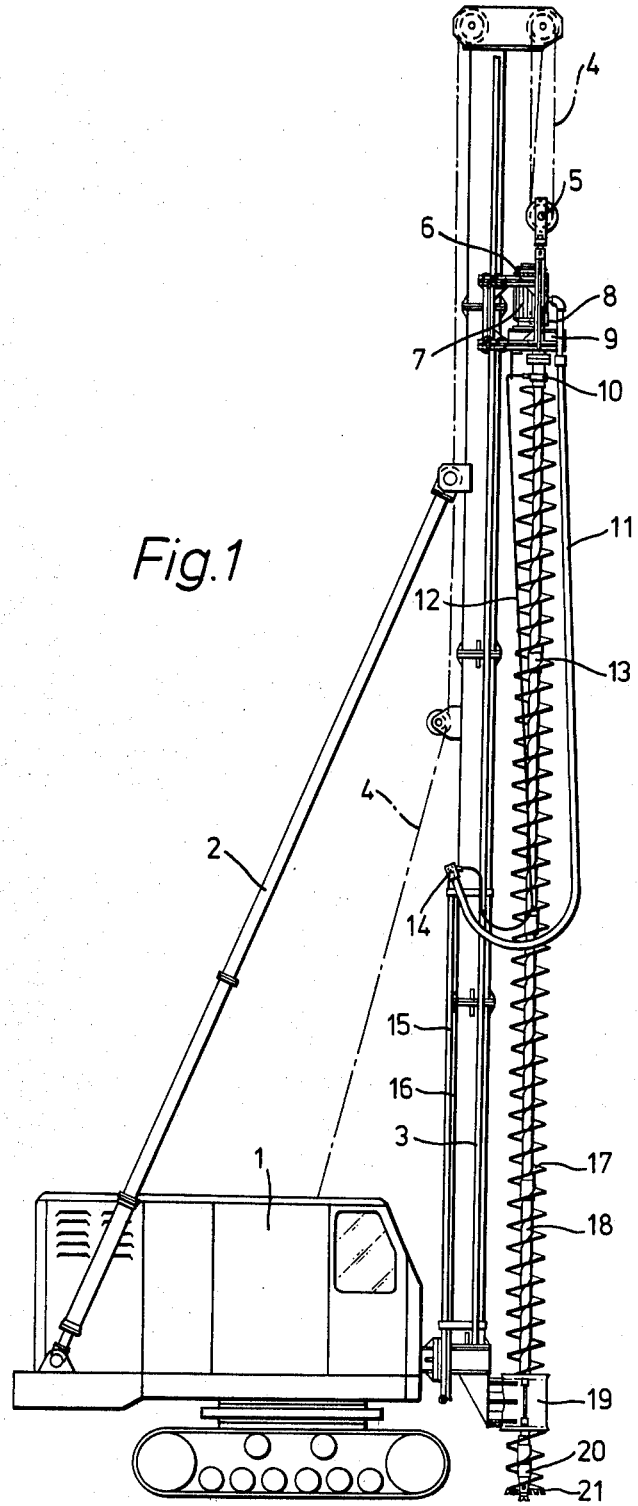
FIG. 1 is a partially schematic side elevational view of a drilling rig including an auger in accordance with the invention.

Referring initially to FIG. 1 of the accompanying drawings a drilling rig comprises a vehicle 1 in the form of a crawler which comprises a body or cab which is swivelably mounted on a caterpillar track, the body or cab incorporating appropriate motors or the like. Two stays 2 are connected to the rear of the body or cab and serve to support a vertical leader or support column. A wire rope 4 is provided which leads from an appropriate winch within the body of the vehicle 1 over pulleys provided at the top of the leader or support column 3 to a hoisting tackle 5 which supports a carriage 6. The carriage 6 is provided with appropriate wheels which engage appropriate parts of the vertical leader 3 so that the carriage can move smoothly upwardly and downwardly when the wire 4 is winched in or wound out from the drum within the body of the vehicle 1. Mounted on the carriage 6 is an auger drive motor 7, which may be a pneumatic motor, an electric motor, or a hydraulic motor, depending upon the torque required and the economic efficiency desired. A swivel connection or head 8 for pipes carrying concrete or the like is provided on the carriage 6 located immediately above a gear box 9 containing reduction gearing which is associated with the motor 7, and a corresponding swivel connection or head 10 for air supply pipes is located immediately below the gear box 9 at the top of the stem of the auger. A flexible hose 11 for conveying concrete or the like is connected to the swivel head 8, and a corresponding flexible hose 12 for compressed air or the like is connected to a swivel head 10. The hoses 11 and 12 are each connected to a swivel joint 14 mounted on the stem 3 and a material pipe 15 and compressed air pipe 16 lead away from the swivel joint 14 to sources of the material and compressed air (not shown in FIG. 1).

The auger comprises a plurality of components, each component comprising an auger helix 17 which is mounted on a central tubular auger stem 18, sections of the auger being interconnected by couplers 13. At the base of the vertical leader 3 the auger passes through a guide 19 which is in the form of a tubular member firmly mounted on the leader 3. At the lowermost end of the auger an auger head is provided which has a stem 20 and a bit 21.

Figure 2:
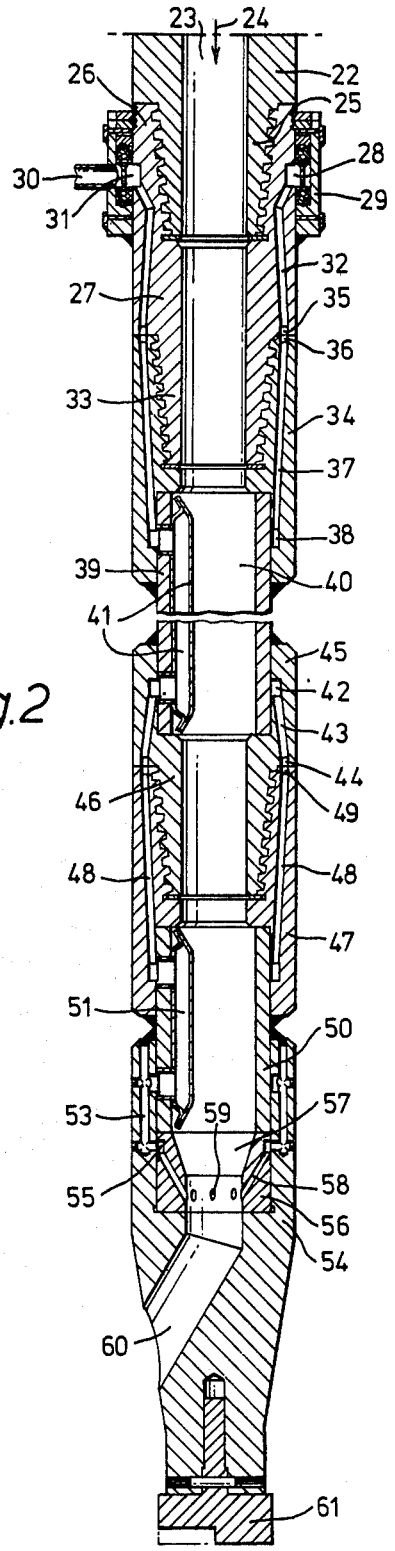
FIG. 2 is a sectional view of part of the auger stem of the apparatus illustrated in FIG. 1 indicating how the sections of the stem are interconnected the helical auger blade being omitted for reasons of clarity of illustration.

FIG. 2 illustrates the uppermost part of the auger stem, and the lowermost part of the auger stem.

The auger stem is hollow and the uppermost part of the auger stem comprises a tubular member 22 which is connected, via the gearbox 9 to the motor 7. Concrete material is supplied to the hollow interior 23 of the member 22 in the direction of the arrow 24, this material flowing through the hose 11 and through the swivel head 8, these components not being shown in FIG. 2. The member 22 is a male member and terminates in a conical exteriorly screw threaded portion 25. This screw threaded portion 25 is inserted into a corresponding conical interiorly screw threaded portion 26 of a member 27 which forms part of a coupling device. The member 27 is again a tubular member having inner and outer diameters corresponding to the inner and outer diameters of the member 22. The member 27 is provided with a peripheral groove 28 and an annular member 29 having a greater diameter than the diameter of member 27 is provided which is located adjacent the groove 28, the annular member 29 being mounted for rotation relative to the member 27. The annular member 29 is provided with an inlet conduit 30 which is connected to a source of compressed air, for example, by means of flexible hose 12. The arrangement is such that the inlet conduit 30 communicates with a chamber 31 which is defined within the member 29 at least partially by the groove 28, and thus, as member 27 rotates the conduit 30 may be maintained in a fixed position, there being a continuous supply of compressed air to the groove 28. A plurality of channels 32 are formed within the member 27, these channels 32 each extending from the groove 28 to an end face of the member 27 adjacent the base of a further exteriorly threaded conical portion 33. An auger element is connected to the conical exteriorly threaded portion 33 of the member 27 by means of a conical interiorly threaded member 34. The channels 32 within the member 27 terminate in an annular groove 35 which is formed in the flat end face of the member 27 adjacent the base of the conical portion 33. A similar annular groove 36 is provided in the flat end face of the member 34 adjacent the interiorly threaded recess. When the two members have been connected together the channels 32 are thus in communication with the recess 35 and the recess 35 is in communication with the recess 36. Further channels 37 are formed within the member 34, these channels extending to a groove 38 which surrounds a cylindrical member inserted into the end of the member 34 remote from the conical exteriorly threaded member 33. The tubular member 39 forms the stem of the auger and has an auger helix (not shown) connected thereto. The member 39 is tubular and the main bore 40 within the member 39 is provided to accommodate the flow of the concrete material. Within the main bore is defined a second tube 41, this tube being connected by means of an aperture within the wall of the tube 39, with the recess 38, so that compressed air can flow through the interior of the tube 41.

At its lower end, the member 29 is provided with a connector which again comprises a member having an annular recess 42 in communication with the interior of the tube 41, this recess 42 being connected by means of channels 43 to an annular recess 44 which is in a flat end portion of the end member 45 adjacent a conical exteriorly tapered portion 45. It will be appreciated, from FIG. 2 of the accompanying drawings that the member 45 may be screw threadedly connected to another member 34, thus permitting an auger of any desired length to be made merely by interconnecting the appropriate number of appropriately designed parts. The auger head is connected to the exteriorly threaded conical portion 46 of the member 45 by means of a corresponding member 47, the member 47 having air channels 48 therein which communicate with a groove 49 which abuts the groove 44. The member 47 is again connected to a short tubular portion 50 which has defined therein a second tube 51, the tube 51 corresponding with the tube 41 and being connected, at its upper end, in a similar way to the air channels 48. At its lower end the tube 51 is connected to an air passage 53 formed within the walls of a head member 54 which surrounds the tube 50. The air passages 53 extend beneath the tube 51 and then communicates with a peripheral annular groove 55 which is formed in a member 56 which is centrally located within the head member 54 and which defines part of the central bore 57 through which the concrete material flows. The peripheral groove 55 within the member 56 is connected by a plurality of air channels 58 to apertures 59 which open into the bore 57. The bore 57 then continues through an inclined portion 60 to the exterior of the head 54. Located at the bottom of the head 54 is a tungsten carbide pilot bit 61 which facilitates cutting.

Figure 3:
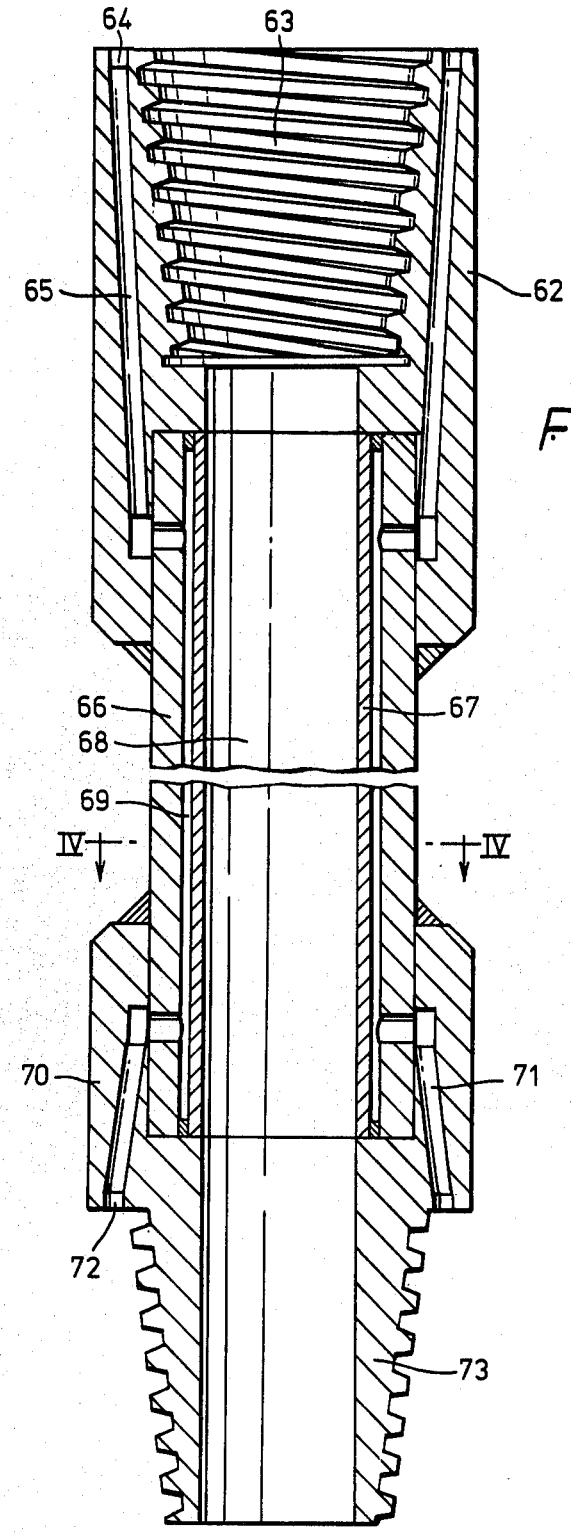
FIG. 3 is a cross-sectional view of one element of a modified type of auger stem again with the auger blade omitted for reasons of clarity.
Figure 4:
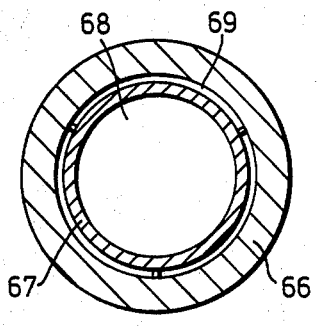
FIG. 4 is a cross-sectional view taken on the line IV—IV of FIG. 3.

FIG. 3 illustrates an alternative auger stem with a different arrangement of passages and a member 62 having a screw threaded tapered portion 63 at one end with an associated recess 64 in the end face and air channels 65 is connected to a tubular member 66 which has an inner tubular member coaxially located therewithin to define a central bore 68 to accommodate the flow of concrete or like material and an annular exterior channel 69 for the flow of compressed air or the like. The tubular member 66, at its lower end, is connected to a complimentary member 70 which is adapted to cooperate with the member 62, the member 70 having air channels 71 which communicate with the annular passage 69 and which terminate in recess 72 in the end face of the member 70, the end face of the member 70 being provided with a conically exteriorly tapered member 73 which is adapted to mate with the portion 63 of a corresponding member. FIG. 4 shows a cross-sectional view of this arrangement.

Figures 5, 6, 7, 8, 9:
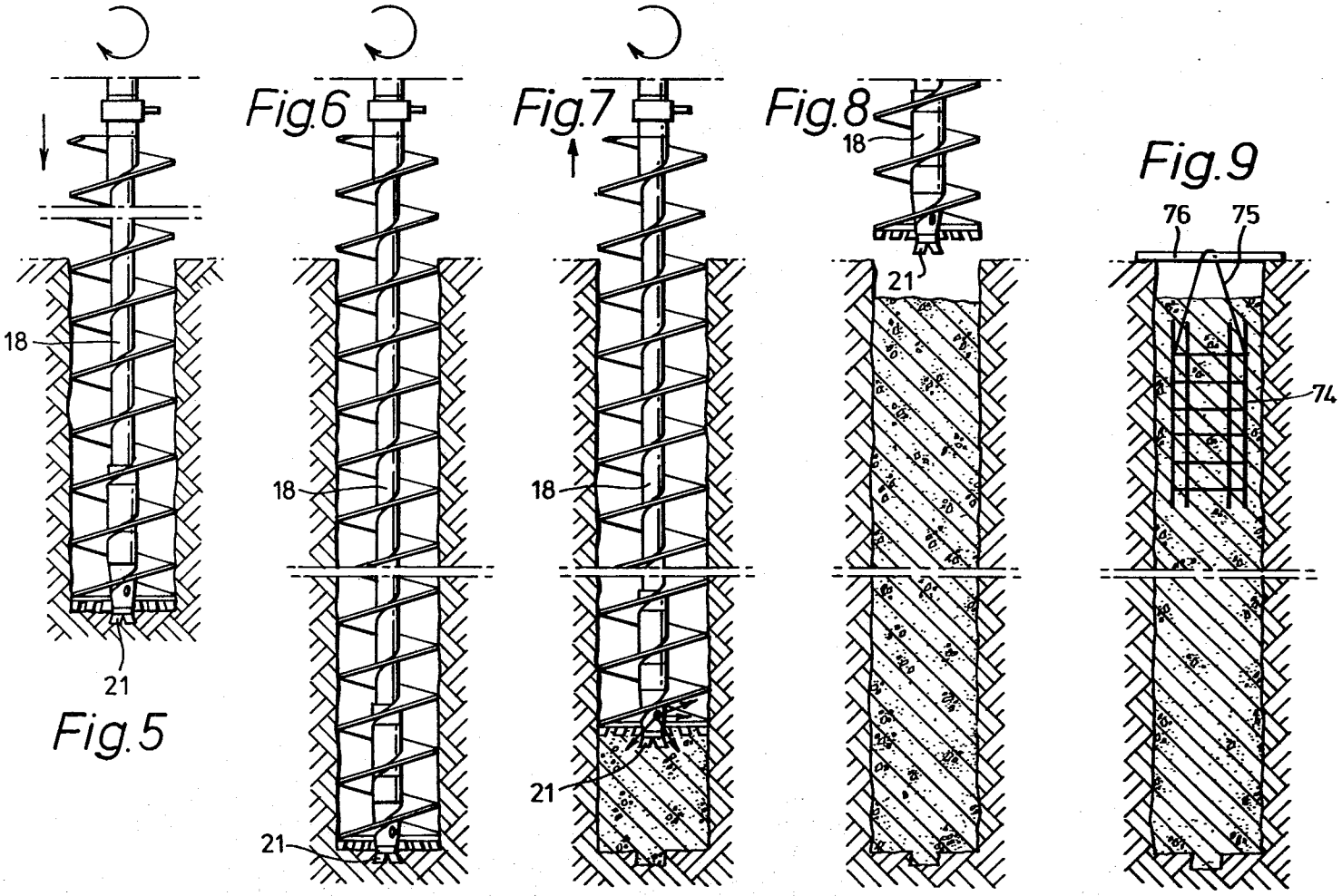
FIG. 5 is a schematic cross-sectional view of an auger drilling a hole.
FIG. 6 is a cross-sectional view of the hole of FIG. 5 when completed.
FIG. 7 is a cross-sectional view of the hole of FIG. 6 when partially filled with concrete.
FIG. 8 is a diagrammatic cross-sectional view of the hole of FIG. 6 when completely filled with concrete.
FIG. 9 is a diagrammatic view of the hole of FIG. 6 when filled with concrete and when provided with reinforcing bars.

Turning now to FIGS. 5 to 9 of the accompanying drawings, in utilising the apparatus described above the vehicle 1 is moved to a desired position, and a desired number of auger elements are interconnected to form the auger before the commencement of the drilling operation. The drilling operation is commenced, as shown in FIG. 5, to auger serving the drill a substantially cylindrical hole in the ground. The auger motor 7 rotates the drive shaft 22 through the reduction gearing in the gear box 9. The auger carriage 6 is gradually lowered by means of the winch within the body of the vehicle and the wire rope 4. The lower part of the auger assembly is kept in place by the auger guide 19 during the drilling process and it is to be appreciated that an intermediary moving auger guide (not shown) may be provided on the leader 3 if the auger elements have a large combined length. If necessary the drilling process may be terminated and fresh auger elements may be connected to the auger elements already drilled into the ground thus enabling holes of considerable depth to be drilled.

When the required depth has been reached, as illustrated in FIG. 6, the formation of the pile is initiated. In one embodiment of the invention a mixture of portland cement, sand, coarse aggregate and water, or another suitable combination of materials is pumped or gunned through the pipe 15, the swivel joint 14, the flexible hose 11 and the swivel joint 8, to pass down the hollow central stem of the auger to reach the portion of the bore 60 at the head of the auger. Simultaneously the compressed air at an appropriate pressure, is provided through the air pipe 16, the flexible hose 12, the swivel joint 10, and the appropriate air passages 32, 37, 38, 41, 42, 43, 44, 49, 48, 51, 53, 55 and 58 to the nozzles 59 where the air is ejected under pressure, into the portion of the bore 57 containing the concrete material to force the concrete material out through the bore portion 60 close to the bottom of the auger. During this process the auger is gradually removed from the hole, the auger being rotated at an appropriate speed in the same direction as during drilling and being lifted by means of the hoisting tackle 5.

The rate of withdrawal of the auger is chosen to correspond to the rate at which material is introduced into the hole so that a complete and continuous pillar of concrete is formed within the hole. When the auger has been completely removed from the hole and the hole has been filled to a sufficient depth with concrete, as illustrated in FIG. 8, then, as illustrated in FIG. 9, a steel reinforcing cage 74 may be lowered into the hole and suspended in position by means of a wire or rope 75 which engages a rod 76 extending across the hole.

It has been found that by using an auger in sinking a hole, the hole can be formed much more quickly than using the prior proposed casing tube. Also it has been found that since the hole is formed by an auger boring through the ground, the resultant bore has a rough external finish believed to be due to inconsistencies in the soil, and also believed to be due at least partially to a combination of linear rotary and unintentional vibratory-wobbling movements of the auger bit and helix. Thus, when this hole having a rough irregular surface is filled with concrete, the concrete is firmaly bonded to the surrounding ground.

It is to be appreciated that since the auger comprises interconnected components, and since these components may each be designed to have any desired length it will be possible to utilise a relatively short drilling rig in the formation of long or deep piles, since when a number of auger elements have been drilled into the ground, further auger elements may be added to them. This may prove to be beneficial where a pile is to be produced where there is only limited head room.

It is to be appreciated that the compressed air emerging through the apertures 59 adjacent the bit of the auger serves to ensure that a positive constant and proper pressure is applied to the concrete material as it is discharged at the bottom of the auger, thus causing a strong pile to be built. This is in contrast to prior proposed methods, such as the cement grouting process, where concrete is merely pumped into a recess, the only pressure applied to the concrete being applied at the pumping plant which is remote from the point of material discharge.

Since the concrete is ejected under the pressure of the compressed air from the bore portion 60, the concrete will flow into any adjacent underground channels or voids, filling these channels or voids. This overcomes a disadvantage that has been experienced with other prior proposed methods of forming a pile in which cement grout is merely introduced into a hole in that if there is a channel or void near the hole the cement grout may not flow into that channel or void until sufficient concrete grout has been introduced to the hole to raise the static pressure within the cement grout adjacent the channel or void to a sufficient level to cause the cement grout to flow into the channel or void. Thus, in prior proposed processes, it has been known for cement grout to flow into a channel or void from adjacent the base of a pile when the casing of the pile is virtually complete.

In an embodiment of an apparatus in accordance with the present invention it is possible to use coarse and fine aggregates in the mixture of material pumped through the hollow stem of the auger, and thus the costs will be relatively low, particularly when compared with the cement grouting process in which it has been customary to use only sand in the mix.

Whilst the invention has been described with specific reference to a process in which wet concrete is pumped through the central stem of the auger, in an alternative process dry materials are pumped through the central bore of the auger stem, and water is provided, with compressed air, through the air passage and is applied to the mixture at the nozzle in the auger head while forcing the mixture out into the drilled bore.

Where a number of auger elements are to be used, spare auger elements may be stored along side the leader 3 of the apparatus illustrated in FIG. 1 and may be located in positions by means of auger holders and auxiliary hoisting tackles.

It is to be appreciated that various types of helix design of the auger head may be utilised depending upon the condition of the soil to be drilled.

I claim:

1. A method for forming a pile in the ground with a sectional helical auger having a central stem in the form of a tubular member which permits the conveying of concrete forming material and a means for conveying compressed air and water from the top of the auger to the bottom of the auger, said method comprising the steps of: forming a hole in the ground with the helical auger; introducing dry concrete-forming material into the hole in the ground through the tubular member positioned in the hole; conveying water from the top of the auger to the bottom of the auger where the water is mixed with the dry concrete-forming material passing through the tubular member to form concrete; forceably ejecting the concrete from the tubular member by means of a substantially continuous flow of compressed air supplied to a nozzle that directs the flow of air into the tubular member adjacent the lower open end thereof; and gradually withdrawing the tubular member from the hole as the hole is filled with concrete.

2. A method according to claim 1 wherein the concrete forming material comprises an appropriate mixture of cement, sand and/or aggregate and/or other material.

3. A method according to claim 1 wherein the tubular member is continuously withdrawn from the hole as the hole is filled with concrete.

* * * * *